US005315903A

United States Patent [19]

Monaco

[11] Patent Number: 5,315,903

[45] Date of Patent: May 31, 1994

[54] UNIVERSAL, SELF-BLOCKING VICE KEY

[76] Inventor: Eugenio Monaco, Via S. Calepodio, 36 00152, Rome, Italy

[21] Appl. No.: 688,572

[22] PCT Filed: Sep. 26, 1990

[86] PCT No.: PCT/IT90/00078

§ 371 Date: May 24, 1991

§ 102(e) Date: May 24, 1991

[87] PCT Pub. No.: WO91/04834

PCT Pub. Date: Apr. 18, 1991

[30] Foreign Application Priority Data

Sep. 28, 1989 [IT] Italy ..... 48410 A/89

[51] Int. Cl.[5] ..... B25B 13/28

[52] U.S. Cl. ..... 81/91.3; 81/91.2

[58] Field of Search ..... 81/91.3, 90.1, 90.9, 81/91.1, 91.2, 94, 97, 98, 99, 100, 111

[56] References Cited

U.S. PATENT DOCUMENTS 615,643 12/1898 Strahle .
701,237 5/1902 Wight .
1,191,325 7/1916 Liesemeyer .

FOREIGN PATENT DOCUMENTS 648542 12/1928 France .
2186221 12/1987 United Kingdom .

*Primary Examiner*—D. S. Meislin
*Attorney, Agent, or Firm*—Beveridge, Degrandi, Weilacher & Young

[57] ABSTRACT

A vise assembly which is able, with one single operation, to adapt to a nut and to lock into position with respect to the nut positioned between a pair compressing jaws. The locking function is readily releasible with a releasing device. Thus, with one direction of rotation of the vise assembly the vise assembly is adapted to conform and lockingly engage the nut and with an opposite direction of rotation, the vise assembly jaws automatically release upon activation of the releasing device.

7 Claims, 2 Drawing Sheets

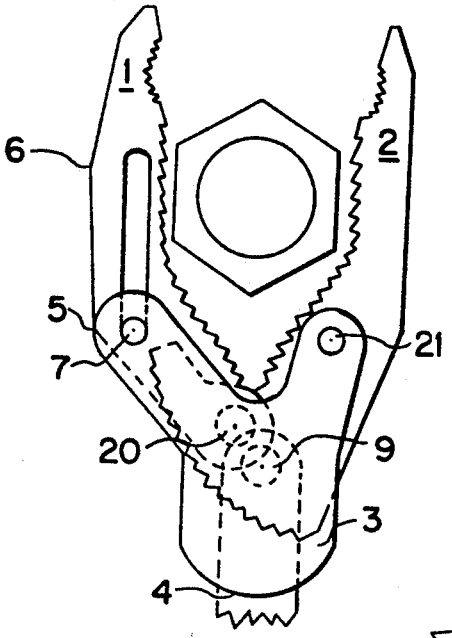
FIG. 1
FIG. 2(A)
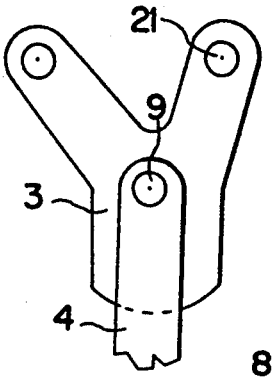
FIG. 2(B)
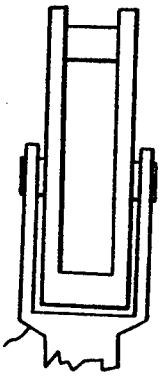
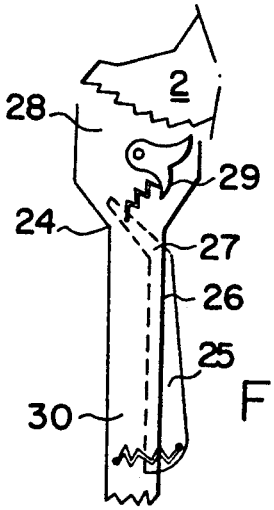
FIG. 3
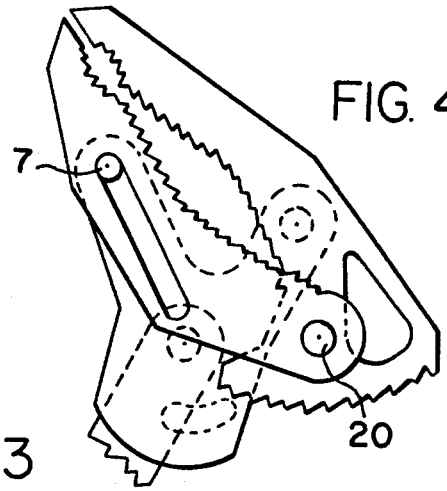
FIG. 4
FIG. 5
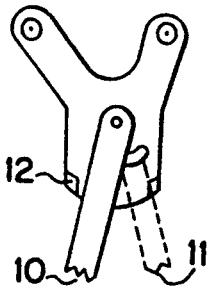
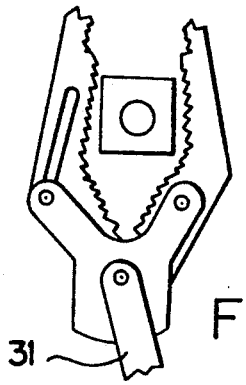
FIG. 6
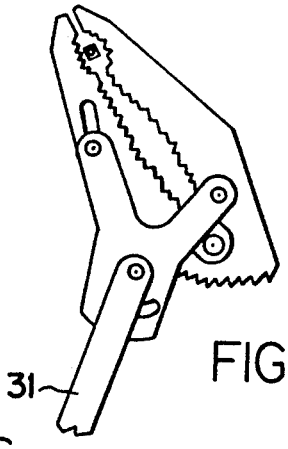
FIG. 7
FIG. 8
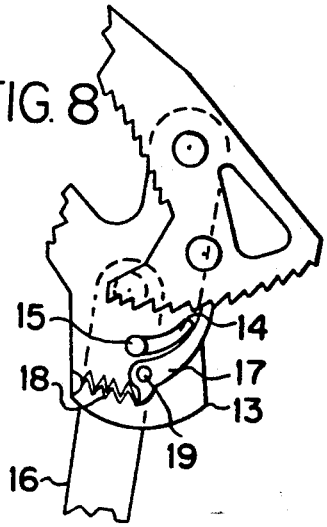

UNIVERSAL, SELF-BLOCKING VICE KEY

FIELD OF THE INVENTION

The present invention concerns a universal, self-locking vise assembly having, at the same time, a fixable and movable pair of jaws.

BACKGROUND DISCUSSION

Actually, there are two fundamental kinds of vise assemblies or gripping devices: one with jaws that are fixed in position in accordance with the many different dimensions of nuts, and the other kind with movable jaws. In this last kind, for obtaining the locking and therefore the rotation of the nuts, the two jaws must be adapted to the different dimensions of said nuts through the movement of an adjustment screw or by means of other known methods.

SUMMARY OF THE INVENTION

The vise assembly or gripping device according to the present invention is able to obtain, with one single operation, the adaptation to the nut as well as the locking thereof and therefore the rotation thereof for each dimension of said nut. In the same way, it works also for tubes, square tiles, etc.

BRIEF DESCRIPTION OF THE PREFERRED EMBODIMENT

The present invention is described more in detail hereinbelow according to the enclosed drawings, in which a preferred embodiment is shown.

FIGS. 1, 2A, 2B, 3-5, and 6-9 respectively show a scheme with details and an axonometric view with details of a self-locking vise assembly.

FIGS. 10A, 10B, 11 and 12 show two lateral views and a cross section of the vise assembly.

DETAILED DESCRIPTION OF THE PREFERRED EMBODIMENTS

Figure 9:
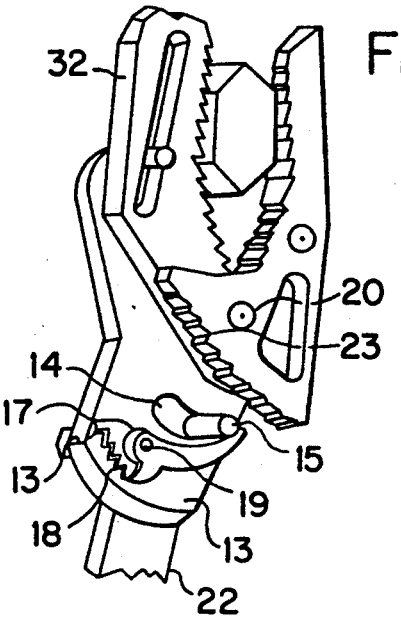

The FIGURES show a universal, self-locking vise assembly mainly consisting of four pieces: two jaws 1 and 2, a fork 3 and a handle 4.

In the proportions shown in the FIGURES, said jaw 1 has a groove of 5 cm length and 4 to 8 mm width, and is placed in the exact position shown in the drawing, i.e. it respects the exact proportions between said groove and the (toothed and non-toothed) lines of the perimeter of the jaw. The lower beginning or first abutment end of the jaw is at 5 mm distance from edge 5, and the opposite abutment end thereof is at 7 mm distance from edge 6.

Said groove has the function of guiding the pin (or the roller-pin) 7, which is formed out of one piece with a fork 3. Said fork 3 is connected to handle 4 by means of pin 9.

The handle however may assume, by means of a displacement of about 1 cm with respect to said fork, position 10 shown at the left side of FIG. 5, and position 11 shown in dotted lines at the right of said FIGURE. The handle is stopped in its movement on the right and on the left by means for limitating rotation of said handle with respect to said fork such as stops 12 (small square projections), coming out of the fork.

Said movement of the handle serves for the self-locking of the vise assembly with respect to the nut (in the dotted lines between the two jaws) in the following way: in FIGS. 8 and 9, the detail 13 shows one of the internal sides of the fork (in section and in axonometric view). Detail 14 shows a slot 14 in the fork having the shape of a section of circumference (about 1 cm) with the center in pin 9.

In said slot, a tooth (or pin) 15 slides, since it is formed out of one piece with the handle, when said handle moves to position 16 to the left. Through use of a means for locking one of said jaws with respect to the fork, both jaws move into position about the nut. The means for locking one of said jaws includes a pawl 17, an expansion spring 18, and a toothed edge on one of the jaws. Pawl 17 locks the jaw 2 in the following way: an expansion spring 18 (that may be of different kind) has a left end attached to the fork and a right end that pushes constantly on the pawl 17 (through its hook). Reference 19 shows a pin, formed as one piece with fork 3, on which the pawl rotates such that the pawl gets inserted between the (saw) teeth of jaw 2 locking the same. Also jaw 1 is locked because it is connected to jaw 2 by pin 20 and because jaw 2 may rotate on pin 21 which is out of one piece with fork 3. In that way the vise assembly becomes fixed for any different opening relative to the different dimensions of the nuts (or other component being worked upon). It is important to emphasize that the action of the hand—while it rotates the handle to the left on pin 9, pushes, by means of stop 12, the fork 3 of FIG. 1 and 13 of FIGS. 8 and 9 to the left for screwing. Therefore, moving the fork to the left, causes the pin, with the roller 7 formed out of one piece with the same, to slide in groove 4 topwards so as to generate a pressure, due to the hand and the arm, always growing by the action of the two jaws 1 and 2 on the nut shown in dotted lines. So is occurs that jaw 1 is pushed so as to close towards jaw 2, which levers on pin 20 which connects the two jaws and on pin 21 which is formed out of one piece with the fork on which jaw 2 rotates. Once the left-turned screwing movement is completed the handle is moved, as usual, rightwards and therefore it assumes the position 22 shown in FIG. 9. In that way the tooth or pin 15, which is formed out of one piece with the handle, moves slidingly in slot 14 of the fork and pushes the pawl 17, releasing it from teeth 23 of jaw 2, which therefore becomes free to open together with jaw 1, releasing the nut shown in dotted lines. Thus, the vise assembly includes means for releasing said locking relationship between the pawl and one of the jaws. Upon release, the already described screwing movement may be started again.

In a variant according to the present invention, the locking teeth may be provided on jaw 1 and not on jaw 2, without any modification in the functioning. For what concerns the locking of the jaws, according to the different working requests, it may be obtained in the following way: the hand 30 is rigidly connected (e.g. formed out of one piece) to the fork in the central point 24. Inside said handle, on the right side, a small lever 25 is provided that projects for nearly all of its length to the side of handle 30. Said small lever is pivoted at pivot pin 26 and has at its upper end an inclined section 27, which extends beyond pin 26, and maintains spring 28 in a fixed position. The other end of said spring is fixed to the hook of the pawl 29. FIG. 3 shows a spring housed inside the handle 30 which, with a light pressure, pushes the small lever 25 outwardly to the right of said handle. Therefore, during the screwing operation, the handle is firmly kept in that hand that mainly pushes on the right of the handle and moves the small lever towards the inside. Then the compressed spring 28 pushes the pawl 29 to lock the teeth of the jaw 2. It shall be emphasized that, when the vise assembly is in resting position, the pawl is kept by spring 28 and by the lever arm 27 out of the teeth of jaws 2, i.e. out of a locking phase. Once the screwing is completed, the hand releases the grasp for bringing back the handle from left to right and so the lever 25 is automatically released to the right by means of spring 30, unhooking the pawl from the teeth of jaw 2. Thus, the springs act to provide a means for engaging and disengaging the pawl from the toothed edge of the jaws. In this way the two jaws will open for starting again the screwing operation, and so on. Finally, it is important to note that even if one should realize the vise assembly without the locking system—i.e. pawl, spring and jaw 2 without locking teeth—it may work all the same, but with less efficiency.

The detail 8 of FIG. 2 shows a side elevational view of fork 3 and of handle 4. Reference 31 in FIGS. 6 and 7 shows the movement of the handle, of the open and closed jaws, and there is also shown the grasping of a medium sized nut and a small sized nut. Reference 132 in FIG. 9 shows the thickness of the jaws, which is of 5 mm for a medium sized vise assembly like the one shown in the FIGURE. It is evident that also smaller vise assemblies may be realized as well as greater ones for building yards, industries, etc. The material of the keys may be one of the various known special irons (chrome iron, vanadium iron, etc.) that are used for Yale-type vise assemblies pliers, etc. The handle of the medium key may be 16 cm long, and it may be of different shapes, even if the tubular flat shape is preferred. From what has been described hereinbefore it results that by means of the vise assembly according to the present invention also a considerable time saving is obtained in any kind of working.

Figure 11:
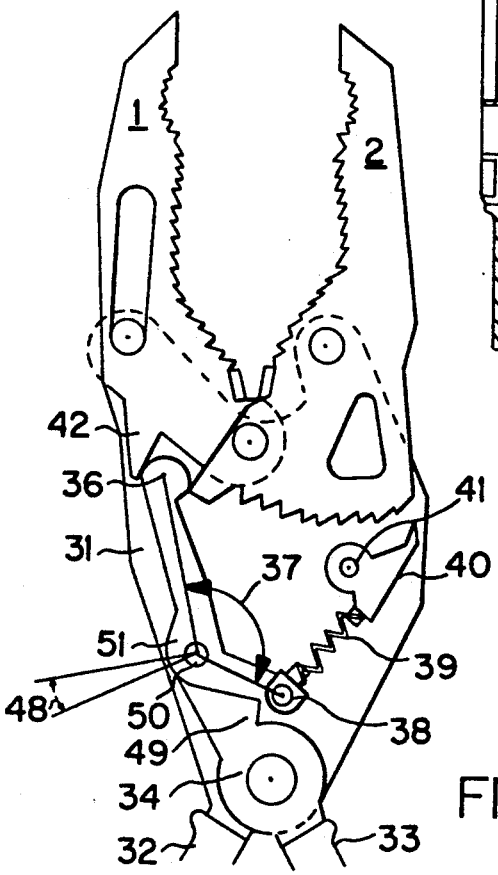
Figure 12:
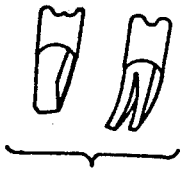

Relating to FIG. 11, reference 31 shows the plate-fork (in enlarged scale with respect to fork 3 of FIG. 1), being formed out of one piece with handle 32. Reference 33 shows the second handle that corresponds to lever 25 of FIG. 3, pivoted upon pin 26, and has the same function. Handle 33 is formed out of one piece with lever 34. Said lever 34 is articulated through pin 35. The articulated part has the following features: the upper end 36 has a head having the shape of a circle. The axes (complete line) of the longer and of the shorter arm are placed at an angle of 124° as shows the detail 37. The lower end has a support articulated on pin 38. The support is out of one piece with pin 38. Spring 39 is connected at its upper part with pawl 40 which, in turn, is pivoted on pin 41. Said pin 41 is formed out of one piece with plate-fork 31.

Figure 10A:
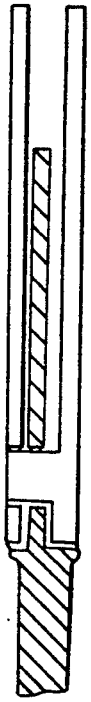
Figure 10B:
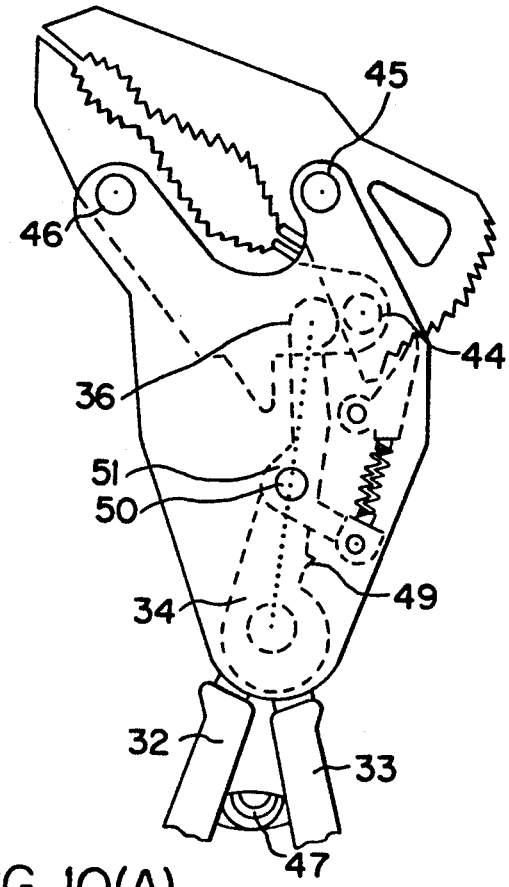

In FIG. 11 the two jaws are shown in their maximum opening position. The (circle-shaped) head 36 is housed between the projection 42 of jaw 1 and projections 43 of jaw 2. The lever arm (with head) automatically determines the opening of the jaws, because it pushes the projection 42 to the left in the following way: the (expansion) spring 47, on the right of FIG. 10, is shown in a compression phase; when it is in expansion phase, it opens the handles 32 and 33, pushes the lever 34 to the left as shown in FIG. 11 and, together with said lever 34, also pushes the articulate lever arm with head. At the same time, the arm with head performs a minimal rotation of only 10° on pin 35, shown at 48. This occurs because the lever arm, that carries pin 38 of the spring support, is stopped by tooth 49 of lever 34. The 10° are measured with respect to the dotted line (FIG. 11) from the center of the head 36 passing through the center of pin 35 and through the center of the axis of the handles. Jaws 1 and 2 of FIGS. 10 and 11 are identical to those of FIG. 1, but are furthermore provided with two projections 42 and 43, respectively on jaw 1 and jaw 2.

Said projections receive the movements of the circle-shaped head 36, the one to the right and the other one to the left. It is fundamental to emphasize that lever 34 has the main function of locking or releasing the teeth of jaw 2 by means of spring 39 and pawl 40, and furthermore of being a guide for the movements of the two jaws when the key is to be used like a common plier. This means that when it is used like a (fixed or not) vise assembly, all pressures, tensions and efforts that occur during working are supported only by the two jaws, by the fork and by the pins 45, 46 of FIG. 10. Therefore, in FIG. 11 the two open jaws are shown (when the assembly is in resting position) because the lever with the head is pushed to the left by lever 34 through pin 35 which, being out of one piece with the handle 39, is moved by spring 47 of FIG. 10. Thus the head pushes the projection 42 and therefore jaw 1 to the left. At the same time, the lever with head, moving its own axis (10°) pulls to the left the spring 39 that moves pawl 40 downwards, which therefore releases the teeth of jaw 2. When the vise assembly is working, the two handles 32 and 33 are obviously moved one towards the other. As it is shown in FIG. 10, it occurs that the lever 34, moving to the right through pin 35, forces the lever with head to assume the rigid position, i.e. on the same (dotted) line, and the alignment takes place, because the two teeth 50 and 51 of FIG. 10, respectively placed one on lever 34 and the other one on the arm with head, fall together (thus annulling the 10° of the precedent rotation).

At the same time, the support 49 pushes the spring 39 which pushes the pawl 40 upwards for locking one of the teeth of jaw 2 (according to the dimensions of the nut). Still at the same time, head 36 pushes projection 43 of jaw 2 to the right so that the two jaws pass from the same opening FIG. 11 to the same closing (FIG. 10).

What is claimed is:

1. A vise assembly, comprising:

a handle;

a fork pivotably attached to said handle;

means for limiting rotation of said handle with respect to said fork;

a pair of jaws which are pivotably interconnected to each other about a first pivot axis, a first jaw of said pair of jaws being pivotably interconnected with said fork about a second pivot axis and a second jaw of said pair of jaws being slidingly interconnected with said fork;

means for locking one of said pair of jaws with respect to said fork; and means for releasing said locking relationship between said fork and said one of said pair of jaws.

2. A vise assembly as recited in claim 1 wherein said handle and fork rotate about a fixed pivot axis.

3. A vise assembly as recited in claim 1 wherein said means for limiting rotation include a pair of spaced apart stops positioned on said fork and to opposite sides of said handle.

4. A vise assembly as recited in claim 1 wherein said means for locking includes a spring, a pawl and a ratchet toothed edge on one of said pair of jaws, said spring having a first end connected with said fork and a second end connected with said pawl so as bias said pawl into locking engagement with said ratchet toothed edge.

5. A vise assembly as recited in claim 4 wherein said pawl is pivotably mounted on said fork and said means for releasing includes a pin member extending from said handle and through a slot formed in said fork, and said pin being positionable so as to rotate said pawl into a non-contact position upon rotation of said handle.

6. A vise assembly as recited in claim 1 wherein said second jaw of said pair of jaws, which is slidingly interconnected with said fork, has a groove formed therein with first and second abutting ends, and said vise assembly further comprising a sliding pin extending through said groove and supported by said fork.

7. A vise assembly as recited in claim 6 wherein said groove extends essentially parallel with said handle when said handle is in a neutral, non-rotative position with respect to said fork.

* * * * *